United States Patent [19]
Owen, II

[11] 4,287,010
[45] Sep. 1, 1981

[54] EMULSION-TYPE EXPLOSIVE COMPOSITION AND METHOD FOR THE PREPARATION THEREOF

[75] Inventor: James H. Owen, II, Hagerstown, Md.

[73] Assignee: E. I. Du Pont de Nemours & Company, Wilmington, Del.

[21] Appl. No.: 64,172

[22] Filed: Aug. 6, 1979

[51] Int. Cl.[3] ..... C06B 45/00
[52] U.S. Cl. ..... 149/2; 149/41; 149/60; 149/61; 149/109.6
[58] Field of Search ..... 149/2, 2 T, 41, 60, 149/61, 109.6

[56] References Cited

U.S. PATENT DOCUMENTS

| | | | |
|---|---|---|---|
| 3,161,551 | 12/1964 | Egly et al. | 149/46 |
| 3,447,978 | 6/1969 | Bluhm | 149/2 |
| 3,674,578 | 7/1972 | Cuttermole | 149/2 |
| 3,706,607 | 12/1972 | Chrisp | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,008,108 | 2/1977 | Chrisp | 149/2 |
| 4,102,240 | 7/1978 | Cook et al. | 149/109.6 |
| 4,104,092 | 8/1978 | Mullay | 149/2 |
| 4,110,134 | 8/1978 | Wade | 149/2 |
| 4,111,727 | 9/1978 | Clay | 149/2 |
| 4,138,281 | 2/1979 | Olney et al. | 149/2 |
| 4,141,767 | 2/1979 | Sudweeks et al. | 149/2 |
| 4,149,917 | 4/1979 | Wade | 149/60 |

OTHER PUBLICATIONS

Tatu, "Revue Generale de Teinture, Impression, Blanchiment, Appret. et die Chimie Textile et Tinctoriale", (TIBA) 25 (#1), pp. 21, 23, 25, 27 (1948).

*Primary Examiner*—Edward A. Miller
*Attorney, Agent, or Firm*—Diamond C. Ascani

[57] ABSTRACT

Emulsion-type explosives having improved storage stability are formed by combining an aqueous solution of an inorganic oxidizing salt and an oil in the liquid phase with agitation in the presence of a fatty acid, e.g., oleic or stearic acid, and an ammonium or alkali metal hydroxide, and incorporating dispersed gas bubbles or voids in the resulting water-in-oil emulsion. An emulsifying system including a fatty acid salt is formed in situ. The product contains the fatty acid salt, fatty acid, and hydroxide in a stabilizing equilibrium which permits the product to retain its explosive properties after storage at temperatures as high as 49° C. or more.

23 Claims, No Drawings

EMULSION-TYPE EXPLOSIVE COMPOSITION AND METHOD FOR THE PREPARATION THEREOF

BACKGROUND OF THE INVENTION

1. Field of the Invention

The present invention relates to water-bearing explosive compositions of the water-in-oil emulsion type which contain an aqueous solution of inorganic oxidizing salt as a dispersed phase within a continuous carbonaceous fuel phase, and to an improved method of preparing such compositions.

2. Description of the Prior Art

Water-bearing explosives of the emulsion type have become increasingly attractive in recent years because they can provide the advantages of gelled or thickened water-bearing explosives in terms of performance and safety while being simpler to manufacture and lower in ingredients cost than the gelled products, which require a gelling agent to inhibit component separation and to improve water resistance.

In U.S. Pat. No. 3,447,978, Bluhm describes water-in-oil emulsion blasting agents in which the carbonaceous fuel contains wax and has a consistency such as to hold a specified volume of occluded gas in the emulsion at a temperature of 21° C. Emulsifying agents specifically disclosed generally are of the nonionic type, e.g., sorbitan fatty acid esters. These blasting agents are reported to be capable of being detonated, after storage for 28 days at 21° C., by an 8 cm×8 cm dynamite cartridge. U.S. Pat. Nos. 3,715,247 3,765,964, 4,110,134, 4,138,281, and 4,149,917 describe Bluhm's blasting emulsions modified in various ways to render them cap-sensitive.

Compositions in which ammonium nitrate-containing emulsions are combined with solid ammonium nitrate, ANFO, and gelled explosives are described in U.S. Pat. Nos. 3,161,551, 4,111,727, and 4,104,092, respectively.

In addition to the nonionic emulsifiers described in the Bluhm and related patents, salts of fatty acids also have been used in emulsion-type explosives. For example, in U.S. Pat. No. 3,770,522, Tomic describes the use of a stearate salt, preferably in combination with stearic acid to shorten the emulsification time. This emulsifying system also is described in U.S. Pat. No. 4,008,108. Chrisp, in U.S. Pat. No. 3,706,607, additionally mentions sodium oleate with or without oleic acid, while Cattermole et al., in U.S. Pat. No. 3,674,578, specify calcium, magnesium, and aluminum oleates.

Improvements are needed in the storage stability, or shelf life, of water-in-oil emulsion explosives of the type described above. It goes without saying that however acceptable the explosive properties of the composition may be at the time of manufacture, the composition must retain its ability to perform in the required manner after exposure to the conditions prevailing in storage areas, in transportation vehicles, and in the field. While the explosive properties, e.g., detonation velocity, brisance, and ease of initiation, of an emulsion explosive are related in large measure to the specific oxidizer/fuel system and sensitizing materials therein, these properties also are greatly affected by the physical structure of the composition. Reliability of performance as an explosive requires that the necessary dispersion of the oxidizer salt-containing aqueous phase, in a suitable cell size, in the continuous carbonaceous fuel phase be maintained. While there has been some reference in the art to the storage stability, or shelf life, of certain emulsion-type explosives, the disclosures have been limited to storage at only about 21° C. or lower. Also, some of the compositions which employ the economically attractive anionic emulsifying agents require undesirably heavy primers or boosters to effect their detonation after storage.

It is not unlikely that an emulsion blasting agent will be exposed to temperatures above 21° C. for various periods of time during storage, while being transported, or after being deposited at the place of use. Therefore, the art of blasting is in need of emulsion explosives whose chemical composition and/or physical structure is not deleteriously changed, i.e., whose explosive properties are preserved, after exposure to temperatures above 21° C., e.g., up to at least 32° C. and perhaps as high as at least about 49° C. With specific regard to explosive emulsions employing anionic emulsifying agents, emulsions of this type which can be detonated by a relatively small primer after storage even at temperatures no higher than about 21° C. also would be useful to the art, although such compositions which also are stable at higher temperatures would doubtlessly achieve wider acceptance.

SUMMARY OF THE INVENTION

The present invention provides an emulsion-type blasting composition comprising:

(a) a carbonaceous fuel, i.e., an oil, forming a continuous emulsion phase;

(b) an aqueous solution of an inorganic oxidizing salt forming a discontinuous emulsion phase dispersed within said continuous phase;

(c) dispersed gas bubbles or voids comprising at least about 5 percent of the volume of said composition;

(d) an ammonium or alkali metal salt of a fatty acid, e.g., an oleate;

(e) a fatty acid, e.g., oleic acid; and (f) an ammonium or alkali metal hydroxide in an amount in excess, e.g., in at least about a 25 percent excess, of that which will form by the hydrolysis of said fatty acid salt in water.

The present invention also provides a method of preparing the above-described emulsion-type blasting composition, which method comprises combining an aqueous solution of an inorganic oxidizing salt, preferably ammonium nitrate alone or in combination with sodium nitrate, and a carbonaceous fuel (oil) in the liquid phase with agitation in the presence of a fatty acid and an ammonium or alkali metal hydroxide, and incorporating dispersed gas bubbles or voids in the resulting water-in-oil emulsion. According to this method, an emulsifying system including a fatty acid salt is formed in situ from the fatty acid and the hydroxide at the time when the aqueous solution and carbonaceous fuel are brought together, or just before or after they are brought together. On agitaton, an emulsion forms wherein the aqueous solution is dispersed as a discontinuous phase within the carbonaceous fuel as a continuous phase. Emulsions formed in this manner, i.e., by adding fatty acid and hydroxide to the system at the time the emulsion is to be formed, contain the fatty acid and hydroxide in addition to a salt of the fatty acid. Regardless of the amount of hydroxide employed in the process relative to the amount of fatty acid, the emulsion produced contains fatty acid and hydroxide, the latter in excess of any amount thereof which might form if the fatty acid salt in the composition were to undergo hydrolysis. Conceivably, emulsions produced by the addition of a pre-formed fatty acid salt to the system in the absence of added hydroxide, could contain small amounts of hydroxide, but only to the degree that the fatty acid salt could be hydrolyzed by the aqueous solution of inorganic oxidizing salt. The emulsions of this invention are distinguishable from such products, because inter alia, the hydroxide content of the present emulsions exceeds the amount which will be produced by the hydrolysis in water of the amount of fatty acid salt present in the emulsion.

Emulsion-type explosive compositions produced by the method of the invention have excellent explosive properties, including an ability to compress a lead block about 3.8 centimeters or more when initiated by a small explosive primer after storage for several days at −12° C. and 21° C., and, unless pre-formed fatty acid salt has been added during the process, also at 49° C.

It will be understood that the terms "a carbonaceous fuel", an inorganic oxidizing salt", "alkali metal hydroxide," "fatty acid", and "alkali metal salt of a fatty acid," as used in defining the present blasting composition denote at least one of the specified materials and consequently include one or more carbonaceous fuels, one or more inorganic oxidizing salts, one or more alkali metal hydroxides, one or more fatty acids, and one or more alkali metal salts of fatty acids. In addition, it will be understood that the alkali metal hydroxide(s) and alkali metal salt(s) of fatty acids can be present with or without ammonium hydroxide and an ammonium salt of a a fatty acid, respectively. The term "an ammonium hydroxide" includes unsubstituted ammonium hydroxide as well as organic derivatives thereof such as tetramethylammonium hydroxide.

The blasting compositions of the invention are referred to herein as "emulsion-type" or simply "emulsions". These terms are meant to apply herein to systems wherein the continuous fuel phase is liquid during the formation of the emulsion. These systems can be those in which one immiscible liquid (the aqueous salt solution) is dispersed in another (when the carbonaceous fuel phase is liquid), as well as those in which the continuous fuel phase is a solid at ambient temperature. An example of the first type of emulsion is the one which forms with an oleate/oleic acid/hydroxide emulsifier system. An example of the second type is the one which forms with a stearate/stearic acid/hydroxide emulsifier system. Both systems are considered emulsions herein.

DETAILED DESCRIPTION

The present invention is based on the finding that an emulsion explosive has markedly improved stability if it is made by a method wherein a fatty acid salt is formed in situ from a fatty acid and an ammonium or alkali metal hydroxide when an oil and an aqueous solution of inorganic oxidizing salt are brought together with agitation, instead of being added to the oil or aqueous phase in the totally pre-formed condition. As was stated previously, the resulting product contains a fatty acid salt, a fatty acid, and hydroxide. While it is not intended that the invention be limited by theoretical concepts, it is believed that the in situ method of this invention allows the fatty acid salt (soap) to form at the oil/water interface, where it is present together with free fatty acid, whereby a stabilizing equilibrium is established between the acid/soap at the interface, fatty acid in the oil phase, and hydroxide in the aqueous phase.

Formation of the soap in situ has a beneficial effect on the explosive properties of the resulting emulsion even in the case in which some pre-formed soap may be present in the system, e.g., when the hydroxide and aqueous solution of inorganic oxidizing salt are added to an oil containing soap and fatty acid. This beneficial effect is realized in the emulsion's ability to produce a good lead block compression after storage for three days at −12° C. and at 21° C., e.g., greater than about 3.8 cm when initiated with only a small primer, e.g., 3 grams of a rubber-like extruded mixture of pentaerythritol tetranitrate and an elastomeric binder. However, carrying out the present process in the substantial absence of pre-formed soap is much preferred inasmuch as the resulting emulsions are able to produce the said lead block compression even after storage for three days at 49° C., clearly a pronounced improvement in the stability of emulsion explosives.

The particular technique employed to bring together the aqueous phase (liquor) and the oil, and the starting materials for the soap to be formed in situ, i.e., the fatty acid and the hydroxide, is not critical provided that the solutions and mixtures employed are in the liquid state. This is required for proper contact of the fatty acid and hydroxide for the in situ formation of the emulsifying system, and also for the formation of the water-in-oil emulsion in the presence of said emulsifying system. In one embodiment of the method, for example, two premixes, i.e., (a) a mixture of a liquid carbonaceous fuel (an oil) and a fatty acid, and (b) a mixture of an ammonium or alkali metal hydroxide and an aqueous solution of an inorganic oxidizing salt, are combined and agitated. In this case, the emulsifying system forms when the aqueous salt solution and the oil are brought together. In another embodiment, the hydroxide and aqueous solution are added separately to the oil/acid mixture, preferably hydroxide first. In this case, the emulsifying system forms just before (preferred) or after the aqueous solution and oil are brought together. Although neither required nor preferred, some pre-formed soap may be added, e.g., to the oil, as mentioned previously. Other variations in the order and direction of addition of the oil, liquor, fatty acid, and hydroxide are possible, but as a rule it is more beneficial to combine the oil and fatty acid, and to add the hydroxide and liquor thereto. In the preferred case in which ammonium nitrate is dissolved in the liquor, introducing the liquor below the surface of the oil is advantageous as a means of hindering ebullition and loss of ammonia at the elevated temperatures which are required to keep the liquor in the liquid state.

The specific temperature to which the liquor must be heated to maintain the liquid state depends on the particular salts therein and their concentration, but usually will be at least about 43° C., and preferably in the range of about from 71° C. to 88° C., for the supersaturated aqueous ammonium nitrate solutions ordinarily employed to produce emulsion explosives. In some instances, e.g., when the fatty acid is stearic acid, the combined oil/fatty acid will have to be heated to maintain its liquid state during the preparation of the emulsion. Regardless of how low the melting point of the combined oil/fatty acid may be, however, the latter will be heated to a temperature which is about the same as that of the liquor, to prevent the liquor from solidifying when combined therewith.

In the method of the invention, the combined liquids are agitated, the specific rate of agitation and duration to be used depending on the desired cell size of the internal phase and viscosity. Faster and/or longer agitation results in a smaller cell size as evidenced by higher viscosity. This method results in emulsions of high internal-phase concentration, e.g., about 90 percent by volume, in cell sizes that are small enough to assure the stability of the emulsion without the need of shear rates as high as those provided by homogenizers.

The discontinuous or dispersed (internal) phase in the emulsion is an aqueous liquor or solution of an inorganic oxidizing salt, e.g., an ammonium, alkali metal, or alkaline earth metal nitrate or perchlorate. Representative salts are ammonium nitrate, ammonium perchlorate, sodium nitrate, sodium perchlorate, potassium nitrate, and potassium perchlorate. Ammonium nitrate, alone or in combination with, for example, up to about 50 percent sodium nitrate (based on the total weight of inorganic oxidizing salts), is preferred. Salts having monovalent cations are preferred in the present emulsion system because polyvalent cations tend to cause emulsion instability unless they can be complexed or sequestered.

Any carbonaceous fuel that is insoluble in water and is liquid at the temperature at which the emulsion is made can be used to form the continuous phase. Fuels that are liquid at temperatures at least as low as about −23° C. are preferred.

The carbonaceous fuel is an oil, i.e., a hydrocarbon or substituted hydrocarbon that functions as a fuel in reaction with the inorganic oxidizing salt. Suitable oils include fuel oils and lube oils of heavy aromatic, naphthenic, or paraffinic stock, mineral oil, dewaxed oil, etc. The viscosity of the oil has no critical effect on the stability of the emulsion explosives of the invention.

The fatty acid used in the process of the invention, and present in the product of the invention, is a saturated or mono-, di-, or tri-unsaturated monocarboxylic acid containing at least about from 12 to 22 carbon atoms. Examples of such acids are oleic, linoleic, linolenic stearic, isostearic, palmitic, myristic, lauric, and brassidic acids. Combinations of two or more of such acids can be used, as well as the commercial grades of fatty acids. Oleic and stearic acids are preferred on the basis of availability, low-titer oleic acid being especially preferred because the fuel phase of the resulting emulsion remains liquid at ordinary temperatures, a condition which is sometimes advantageous.

The fatty acid reacts in situ with ammonium hydroxide (as previously defined) or an alkali metal hydroxide, preferably sodium or potassium hydroxide, to form the ammonium or alkali metal salt of the fatty acid, e.g., ammonium oleate or stearate, sodium oleate or stearate, or potassium oleate or stearate.

The in situ formation of the emulsifying system in the process of the invention, which system produces a stabilizing equilibrium in the resulting emulsion, depends on controlling the amount of hydroxide added relative to the amount of fatty acid employed. When, as in the preferred case, the ammonium ion is present in the liquor (i.e., when ammonium nitrate is the oxidizing salt, or one of the oxidizing salts, therein), and the fatty acid and the hydroxide are combined in the presence of the ammonium ion, more hydroxide has to be used with the specified amount of fatty acid, the hydroxide to acid equivalents ratio to be used in this case being greater than 1 and no greater than about 12, an equivalents ratio of 1 to 7 being preferred. The need for excess hydroxide in this instance is caused by the buffer capacity of such a system, in which ammonium hydroxide can form. On the other hand, when there is no buffer capacity in the system by virtue of the absence of ammonium ion in the liquor, an hydroxide/acid equivalents ratio of about from 0.4 to 0.7 should be used. If the hydroxide is added to the combined oil/fatty acid before a liquor containing the ammonium ion is added (in such a case the soap, in effect, being formed in an unbuffered system), an hydroxide/acid equivalents ratio of 0.4 to 6.0 is employed.

Regardless of whether the limiting reactant in the emulsifier-forming system is the hydroxide or the fatty acid, the resulting emulsion is found to contain free fatty acid and hydroxide, in addition to the fatty acid salt. Analytical techniques applied to the emulsion indicate that in systems containing the ammonium ion, i.e., in buffered systems, when the hydroxide/fatty acid equivalents ratio used in forming the emulsion is 2/1, about 60–70 percent of the fatty acid is converted to soap in the process, with 30–40 percent of unconverted fatty acid being detectable by extraction from the emulsion with oil. The essentially complete extraction of the fatty acid from the emulsion causes degradation. Using as a standard for emulsion stability the previously described lead block compression of at least about 3.8 centimeters with small-primer initiation, emulsions which are stable after three days at −12° C., 21° C. and/or 49° C. have been obtained when the weight of the fatty acid introduced was in the range of about from 0.4 to 3.0 percent of the total weight of the ingredients used to form the emulsion. The use of fatty acid concentrations at the lower end of this range favors low-temperature stability, while higher concentrations favor high-temperature stability. Fatty acid concentrations of about from 1.0 to 2.0 percent of the total emulsion weight are preferred, because they result in high- and low-temperature stability. However, it is feasible to prepare high-temperature-stable emulsions using high fatty acid concentrations and to achieve low-temperature stability in such emulsions by shearing to a smaller cell size (size of dispersed pockets of the aqueous phase).

Based on the amount of fatty acid introduced, the final emulsion can contain soap and fatty acid each in an amount in the range of from 0.02 to 2.85% of the total emulsion weight.

The stabilizing equilibrium which results from the present process also is related to the presence of hydroxide in the product. The amount of hydroxide in the emulsion exceeds, usually by at least 25%, that which would be obtained were all of the soap therein to be hydrolyzed in water. The emulsion can contain from 0.025 to 5.0 weight-% of the hydroxide.

The salt concentration of the liquor, and the concentration of the aqueous phase in the emulsion will depend on the oxygen balance required in the explosive composition. The inorganic oxidizing salt(s) should constitute about from 50 to 95, and preferably about from 70 to 85, percent of the total weight of the blasting composition, and there should be sufficient fuel to provide an oxygen balance in the final composition of about from −30 to 10 percent, and preferably about from −10 to +5 percent. While the carbonaceous fuel can constitute about from 1 to 10 percent of the total weight of the emulsion, it usually is about from 2 to 6, and preferably about from 3 to 5, percent of the total emulsion weight. The emulsion can be about from 5 to 25 percent (by weight) water, but usually is about from 6 to 20, and preferably about from 8 to 16, percent water.

The emulsion explosive of the invention contains at least about 5 percent by volume of dispersed gas bubbles or voids, which act to sensitize the composition so that it detonates consistently and reliably. Gas bubbles can be incorporated in the composition by dispersing gas therein by direct injection, such as by air or nitrogen injection, or the gas can be incorporated by mechanically agitating the composition and beating air therein. The incorporation of gas also can be accomplished by the addition of particulate material such as air-carrying solid material, for example, phenol-formaldehyde microballoons, glass microballoons, fly ash, or siliceous glass; or by the in situ generation of gas by the decomposition of a chemical compound. Evacuated closed shells also can be employed. Preferred gas or void volumes are in the range of about from 5 to 35 percent. More than about 50 percent by volume of gas bubbles or voids usually is undesirable inasmuch as low explosive performance may result. The gas bubbles or voids preferably are no larger than about 300 micrometers. Glass microballoons can constitute about from 0.3 t0 30.0 percent by weight of the emulsion, but usually about from 0.5 to 20.0 percent, and preferably 1.0 to 10.0 percent, is employed.

Other sensitizers which can be incorporated into the emulsion include the water-soluble nitrogen-base salts of inorganic oxidizing acids, preferably monomethylamine nitrate, such as are described in U.S. Pat. No. 3,431,155, the disclosure of which patent is incorporated herein by reference; and particulate high explosives such as TNT, PETN, RDX, HMX, or mixtures thereof such as pentolite (PETN/TNT) and Composition B (TNT/RDX). Finely divided metallic fuels such as aluminum and iron and alloys of such metals such as aluminum-magnesium alloys, ferrosilicon, ferrophosphorus, as well as mixtures of the aforementioned metals and alloys, also can be used.

The invention will now be described illustratively by means of the following examples.

EXAMPLE 1

A 50% aqueous solution of sodium hydroxide (3.2 milliliters) was added to 300 milliliters of an aqueous nitrate liquor maintained at 77° C. in a pressurized vessel to prevent ebullition. The liquor was a solution which consisted of 70.8% ammonium nitrate, 15.6% sodium nitrate, and 13.6% water by weight. The base-containing aqueous nitrate solution was added slowly with agitation to a 77° C. solution of 8 grams of a commercial oleic acid product in 16 grams of Gulf Endurance No. 9 oil (a hydrocarbon distillate having a molecular weight of about 291 and a Saybolt viscosity of about $9.7\times10^{-6}$ $m^2/s$ at 38° C.), the aqueous solution having been introduced below the surface of the oil solution, and the agitation having been accomplished by a mixer blade having a tip speed of 119 cm per second. The oleic acid product had a titer point of about 5° C. and contained, by weight, 9% saturated fatty acids, 18% unsaturated fatty acids other than oleic acid, and 73% oleic acid.

After 5–30 seconds, the blade tip speed was increased to 203 cm per second while the remainder (200–250 milliliters) of the base-containing liquor was added. After 120 seconds, all of the liquor had been delivered, and the blade tip speed was increased to 600 cm per second and the mixture thereby sheared while being cooled down to about 43°–46° C. (120–600 seconds' cooling time). The density of the mixture at this point was 1.40–1.43 g/cc. A wooden spatula then was employed to mix into the thickened composition 4.7 grams of glass microballoons having a particle density of 0.23 g/cc and 14.1 grams of fly ash (known as "Extendospheres") having a particle density of 0.7 g/cc. The final density of the mixture was about 1.30–1.33 g/cc.

In forming the above product as just described, the hydroxide/acid equivalents ratio was 2/1, and the amount of oleic acid added constituted 1.7% of the total weight of the ingredients used to form the product. Based on the weight of the product, the weight of ammonium nitrate therein was 63.8%, sodium nitrate 14.0%, water 12.8%, oil 3.3%, glass microballoons 1.0%, fly ash 2.9%, and the remainder sodium and ammonium oleates. oleic acid, and hydroxides. The product was an emulsion, i.e., the aqueous liquor had been dispersed in the oil, the cell size of the aqueous phase (determined microscopically) being in the range of 0.5 to 2 micrometers.

The following method was used to establish the presence of an oleate soap (sodium and ammonium oleates) in the emulsion:

Gulf Endurance No. 9 oil (3 milliliters) was added to 4.0 grams of the emulsion with agitation, and the oil layer which separated on standing was analyzed for oleic acid (extracted from the emulsion) by infrared spectroscopy. Then 2 milliliters of 0.3 N hydrochloric acid was added to the oil, the mixture agitated, and the separated oil layer subjected to infrared spectroscopy, whereby additional oleic acid was found. The additional oleic acid found in the oil only after acid treatment was that which was derived from a reaction of oleate ion (extracted from the emulsion) with the hydrochloric acid.

The same emulsion, made less sensitive by having a 34% water content, was broken by adding 20 milliliters of water, sealing in a test tube, and heating to 49° C. until phase separation. After cooling, the amount of hydroxide in the separated aqueous layer was determined by titration with 0.1 N hydrochloric acid. Based on this analysis, the amount of hydroxide in the emulsion was found to be more than is calculated to be obtainable solely by the hydrolysis in water of the maximum amount of oleate soap that could be produced if all of the oleic acid employed in making the emulsion were to be converted thereto. (Since all of the oleic acid employed was not converted to oleate, even less oleate actually was available for hydrolysis than was used in the calculation of the "hydrolysis-derivable" hydroxide.).

The explosive performance of the emulsion was determined by its ability to compress a lead block when a 425-gram sample, resting on a 1.27-cm-thick steel plate on top of a 10.2-cm-thick cylindrical lead block, was detonated by a cap-initiated 3-gram primer of bonded PETN explosive. After storage for three days at −12° C., 22° C., and 49° C., the emulsion gave lead compressions of 4.8, 5.0, and 5.3, cm, respectively.

Unconfined 14-kg cartridges (polyethylene-wrapped) of the emulsion 12.7 cm in diameter detonated at a velocity of about 5800–6000 m/sec when initiated with a 0.45-kg primer. No loss in velocity was encountered after the emulsion had been stored for 30 days at −18° C., more than 200 days at −12° C., more than 360 days at 4° C., more than 100 days at 38° C., and more than 40 days at 49°–60° C.

EXAMPLE 2

The procedure of Example 1 was repeated with the exception that stearic acid was substituted for the oleic acid, and the temperature of the composition during shearing and incorporation of the microballoons and fly ash was 65°–70° C. The stearic acid product contained, by weight, 95% stearic acid and 5% palmitic acid. Its titer point was 69° C. The emulsion produced had the same ammonium nitrate, sodium nitrate, water, oil, glass microballoon, and fly ash content, and cell size as the emulsion described in Example 1. It contained sodium and ammonium stearate and stearic acid (instead of oleates and oleic acid as in the Example 1 emulsion), and hydroxide, determinable as described in Example 1.

In the lead compression test described in Example 1, the emulsion gave a lead compression of 5.1 cm after three days' storage at −12° C., 22° C., and 49° C.

Control Experiments

A composition made by adding sodium stearate, stearic acid and microballoons to No. 2 fuel oil in the amounts specified in Example 5 of U.S. Pat. No. 3,770,422, mixing at 71° C., adding the oil mixture to the 71° C. aqueous solution of ammonium nitrate and sodium nitrate described in the same patent, and mixing at 66° C. in a Waring blender gave lead compressions of 0.3 cm in the test described above, after subjection to the above-specified storage conditions. These results indicate that products made using a fatty acid salt in the totally pre-formed condition and with no addition of hydroxide to the system cannot be detonated by small (3-gram) primers so as to give any significant lead compression after three days' storage at −12° C., 22° C., and 49° C.

Similar results were obtained when sodium oleate and oleic acid were substituted for sodium stearate and stearic acid in the totally pre-formed soap system.

EXAMPLE 3

The procedure described in Example 1 was repeated except that the same aqueous sodium hydroxide solution was added to the oil, followed by the addition of the aqueous solution of nitrates (containing no hydroxide) to the hydroxide-containing oil/oleic acid solution. The lead compressions obtained with the emulsion product were 5.1 cm after storage at all three specified temperatures.

EXAMPLE 4

The procedure described in Example 1 was repeated with the following exceptions:

(a) 7.7 grams of sodium oleate and 0.8 gram of oleic acid were substituted for the 8 grams of oleic acid, and the amount of sodium hydroxide solution used was 1.6 milliliters;

(b) 4.3 grams of sodium oleate and 4 grams of oleic acid were substituted for the 8 grams of oleic acid, and the amount of sodium hydroxide solution used was 1.6 milliliters;

(c) the same substitution was made for the oleic acid as in (a), but 0.8 milliliter of the hydroxide solution was used.

The (a) emulsion gave lead compressions of 5.6 cm, 5.3 cm, and 0.3 cm after three days' storage at −12° C., 21° C., and 49° C., respectively. The corresponding compressions were 5.6 cm, 5.6 cm, and 0.3 cm for the (b) emulsion; and 5.1 cm, 5.8 cm, and 0.3 cm for the (c) emulsion.

EXAMPLE 5

When linoleic acid having a titer point of 5° C. (6% saturated fatty acids, 31% unsaturated fatty acids other than linoleic acid, and 63% linoleic acid), was substituted for oleic acid in the procedure described in Example 1, the lead compressions obtained with the resulting emulsion (which contained sodium and ammonium linoleates, linoleic acid, and hydroxide) were 5.1 cm after storage at all three specified temperatures.

EXAMPLE 6

Different amounts of a 50% aqueous sodium hydroxide solution were added over a period of 30–120 seconds to 300 milliliters of 50% aqueous sodium nitrate at 22° C., and the resulting solution was added with agitation (mixer blade tip speed of about 203 cm/sec) to a 22° C. solution of 8 grams of oleic acid in 16 grams of Gulf Endurance No. 9 oil. After the addition was complete, the mixture was sheared (mixer blade tip speed of about 600 cm/sec) for an additional 2–5 minutes. The resulting emulsions were stored at 49° C. and monitored for stability by visual observation of separation.

| ml NaOH Soln. | Hydroxide/Acid Equiv. Ratio | Days Stable at 49° C. |
|---|---|---|
| 0.4 | 0.27 | 5 |
| 0.6 | 0.40 | 11–12 |
| 0.8 | 0.54 | 16 |
| 1.0 | 0.67 | 19 |
| 1.1 | 0.74 | 0 |

These results indicate that in this unbuffered system (no ammonium ion is present in this case) the hydroxide/acid equivalents ratio should be at least about 0.4 and no greater than 0.7.

EXAMPLE 7

The procedure described in Example 1 was repeated except that the amount of sodium hydroxide used was different:

| ml NaOH Soln. | Hydroxide/Acid Equiv. Ratio | Lead Compression after 49° C. (cm) |
|---|---|---|
| (a) 1.6 | 1.1 | 4.3 |
| (b) 12.0 | 8.1 | 4.1 |

I claim:

1. A method of producing an emulsion-type blasting composition comprising combining an aqueous solution of an inorganic oxidizing salt and a carbonaceous fuel in the liquid phase with agitation in the presence of a fatty acid and ammonium or alkali metal hydroxide, and incorporating dispersed gas bubbles or voids in the resulting water-in-oil emulsion.

2. A method of claim 1 wherein a mixture of said carbonaceous fuel and said fatty acid is combined with an aqueous solution of said oxidizing salt containing said hydroxide.

3. A method of claim 2 wherein said hydroxide-containing aqueous solution is added to said carbonaceous fuel/fatty acid mixture.

4. A method of claim 1 wherein said hydroxide is added to a mixture of said carbonaceous fuel and said fatty acid, and thereafter said aqueous solution of inorganic oxidizing salt is added.

5. A method of claim 4 wherein about from 0.4 to 6.0 equivalent weights of said hydroxide are employed per equivalent weight of fatty acid.

6. A method of claim 2 wherein said oxidizing salt is one or more alkali metal nitrates, the ammonium ion being absent, and about from 0.4 to 0.7 of an equivalent weight of said hydroxide is employed per equivalent weight of fatty acid.

7. A method of claim 1 wherein said inorganic oxidizing salt is ammonium nitrate, alone or in combination with an alkali metal nitrate.

8. A method of claim 7 wherein more than 1, and no more than about 12, equivalent weights of said hydroxide are employed per equivalent weight of fatty acid.

9. A method of claim 3 or 4 wherein said fuel/fatty acid mixture is heated to keep said aqueous solution from solidifying when added thereto.

10. A method of claim 9 wherein the temperature of the aqueous solution of inorganic oxidizing salt and the temperature of said fuel/fatty acid mixture is at least about 43° C. during the addition.

11. A method of claim 2 or 4 wherein said aqueous solution and said fuel/fatty acid mixture are substantially free of fatty acid salt prior to the combining of said hydroxide with said fuel/fatty acid mixture.

12. A method of claim 1 wherein the weight of said fatty acid is about from 0.4 to 3.0 percent of the total weight of the ingredients used to form said emulsion.

13. A method of claim 1 wherein said fatty acid is oleic acid.

14. A method of claim 1 wherein said fatty acid is stearic acid.

15. An emulsion-type explosive composition comprising:

(a) a carbonaceous fuel forming a continuous emulsion phase;
(b) an aqueous solution of an inorganic oxidizing salt forming a discontinuous emulsion phase dispersed within said continuous phase;
(c) dispersed gas bubbles or voids comprising at least about 5 percent of the volume of said composition;
(d) an ammonium or alkali metal salt of a fatty acid;
(e) a fatty acid; and
(f) an ammonium or alkali metal hydroxide in an amount in excess of that which will form by the hydrolysis of said fatty acid salt in water.

16. An emulsion-type explosive composition comprising:

(a) a carbonaceous fuel forming a continuous emulsion phase;
(b) an aqueous solution of an inorganic oxidizing salt forming a discontinuous emulsion phase dispersed within said continuous phase;
(c) dispersed gas bubbles or voids comprising at least about 5 percent of the volume of said composition;
(d) an ammonium or alkali metal salt of a fatty acid;
(e) a fatty acid; and
(f) an ammonium or alkali metal hydroxide; said composition being that which is obtained by combining said carbonaceous fuel and said aqueous solution with agitation in the presence of said fatty acid and said hydroxide so as to form said fatty acid salt in situ.

17. An emulsion-type explosive composition comprising:

(a) about from 1 to 10 percent by weight of a carbonaceous fuel forming a continuous emulsion phase;
(c) an aqueous solution of ammonium nitrate, or of ammonium nitrate and an alkali metal nitrate, forming a discontinuous emulsion phase dispersed within said continuous phase, said nitrate(s) constituting about from 50 to 95 percent, and water about from 5 to 25 percent, of the weight of said composition;
(c) dispersed gas bubbles or voids comprising at least about 5 percent of the volume of said composition;
(d) an ammonium and/or alkali metal oleate;
(e) oleic acid; and
(f) an ammonium and/or alkali metal hydroxide.

18. An explosive composition of claim 15 or 17 capable of compressing a lead block at least 3.8 centimeters after exposure to temperatures ranging about from −12° C. to 49° C. for at least three days when 425 grams of the composition is initiated by a 3-gram primer of bonded PETN explosive.

19. An explosive composition of claim 15 wherein said fatty acid is a saturated or mono-, di-, or tri-unsaturated monocarboxylic acid containing about from 12 to 22 carbon atoms.

20. An explosive composition of claim 19 wherein said fatty acid salt (d) is ammonium oleate and/or one or more alkali metal salts of oleic acid, and said fatty acid (e) is oleic acid.

21. An explosive composition of claim 19 wherein said fatty acid salt (d) is ammonium stearate and/or one or more alkali metal salts of stearic acid, and said fatty acid (e) is stearic acid.

22. An explosive composition of claim 15 containing, by weight, about from 50 to 95 percent of ammonium nitrate or a combination of ammonium nitrate and an alkali metal nitrate, 5 to 25 percent water, and 1 to 10 percent carbonaceous fuel.

23. An explosive composition of claim 15 or 17 wherein at least some of said gas bubbles or voids are provided by gas- or void-occluding particulate solids.

* * * * *